US009127471B1

(12) United States Patent
Greer et al.

(10) Patent No.: US 9,127,471 B1
(45) Date of Patent: Sep. 8, 2015

(54) SPA COVER WITH INFLATABLE BLADDERS

(71) Applicant: Roberts Manufacturing LLC, San Diego, CA (US)

(72) Inventors: Jerry Greer, Tustin, CA (US); Robert Ghelerter, La Jolla, CA (US); Justin Jobe, San Diego, CA (US)

(73) Assignee: ROBERTS MANUFACTURING LLC, San Diego, CA (US)

( * ) Notice: Subject to any disclaimer, the term of this patent is extended or adjusted under 35 U.S.C. 154(b) by 0 days.

(21) Appl. No.: 14/565,992

(22) Filed: Dec. 10, 2014

(51) Int. Cl.
*E04H 4/00* (2006.01)
*E04H 4/10* (2006.01)

(52) U.S. Cl.
CPC ..... *E04H 4/103* (2013.01)

(58) Field of Classification Search
CPC ..... E04H 4/103
USPC ..... 4/499, 58
See application file for complete search history.

(56) References Cited

U.S. PATENT DOCUMENTS

| | | | |
|---|---|---|---|
| 4,048,678 | A | 9/1977 | Chillino |
| 4,122,562 | A | 10/1978 | Sorrentino |
| 4,535,490 | A | 8/1985 | Wright |
| 4,606,083 | A | 8/1986 | Kingston |
| 4,744,112 | A | 5/1988 | Keesling, Jr. |
| 4,825,479 | A | 5/1989 | Bonneau |
| 4,847,925 | A | 7/1989 | Perry |
| 4,953,239 | A | 9/1990 | Gadsby |
| 5,144,704 | A | 9/1992 | Genzel et al. |
| 5,367,722 | A | 11/1994 | Pesterfield |
| 5,373,590 | A | 12/1994 | Svae et al. |
| 5,799,345 | A | 9/1998 | Hansen et al. |
| 5,970,530 | A | 10/1999 | Hansen et al. |
| 6,286,157 | B1 | 9/2001 | Baumann |
| 6,408,453 | B1 | 6/2002 | Song et al. |
| 6,694,539 | B1 | 2/2004 | Kordell et al. |
| 7,032,258 | B2 | 4/2006 | O'Hanlon |
| 7,311,683 | B2 | 12/2007 | Turell et al. |
| 7,662,006 | B2 | 2/2010 | Mollis |
| 7,874,023 | B1 | 1/2011 | Sundling |
| 8,201,285 | B1 | 6/2012 | Pugliese et al. |
| 8,635,999 | B2 | 1/2014 | Rosene et al. |
| 8,813,275 | B2 | 8/2014 | Genova |
| 2007/0143915 | A1 | 6/2007 | Vangelisti |
| 2007/0271692 | A1 | 11/2007 | Herd et al. |
| 2010/0058529 | A1 | 3/2010 | Decker |
| 2014/0357387 | A1 | 12/2014 | Murphy |

FOREIGN PATENT DOCUMENTS

| | | |
|---|---|---|
| EP | 0 768 441 | 4/1997 |
| WO | WO 98/09117 | 3/1998 |
| WO | WO 2007/060485 | 5/2007 |

*Primary Examiner* — Tuan N Nguyen
(74) *Attorney, Agent, or Firm* — Gordon & Jacobson, PC

(57) ABSTRACT

A spa cover is described that is comprised of a plurality of inflatable drop stitch bladders and a slipcover comprising a plurality of separate chambers. Each chamber corresponds to a respective one of the plurality of inflatable bladders, and each chamber is constructed to house a corresponding one of the inflatable bladders therein. The slipcover has a hinge between at least two separate chambers.

21 Claims, 7 Drawing Sheets

SPA COVER WITH INFLATABLE BLADDERS

BACKGROUND

1. Field

The present disclosure relates to spa covers and, more particularly, spa covers with inflatable bladders.

2. State of the Art

Heated spa tubs (i.e., "hot tubs") are conventionally covered with an insulated cover to prevent loss of heat from heated water in the tub. Also, the closed covers can prevent unwanted objects from entering the tub when not in use. In that regard, spa covers should be capable of meeting safety standards. To that end, the covers need to be a support various loads without collapsing. For example, a cover is required to support the body weight of a child without collapsing, when the spa cover is closed over the tub. Also, a spa cover used outdoors should be capable of supporting a snow load.

Conventional spa covers are constructed from a rigid insulative foam core encased in a vinyl cover. Such conventional covers typically fold back off of the tub to allow for user entry. However, one disadvantage of conventional spa covers is that the thickness and density of the foam used makes the covers very heavy for user handling. In addition, such weight requires additional costs for shipping and handling of the covers during transportation. Moreover, over time, the foam core becomes water logged and its insulative properties diminish, thereby necessitating replacement of the cover.

Notwithstanding the disadvantages, the visual appeal of a conventional spa cover is recognized, and popular in the trade and has rendered various proposed alternatives unpopular.

SUMMARY

According to one aspect, a spa cover is described that includes a plurality of inflatable bladders and a slipcover that includes plurality of separate chambers. Each chamber corresponds to a respective one of the plurality of inflatable bladders, and each chamber is constructed to house a corresponding one of the inflatable bladders therein. The slipcover has forms a flexible hinge between at least two separate chambers to permit slipcover with inflatable bladders to be folded back on itself between open and closed configurations.

In one embodiment, the spa cover includes first and second inflatable bladders. Each of the first and second bladders made of a drop stitch construction including a top skin, a bottom skin, and a fiber core comprising a plurality of tension fibers extending between the top and bottom skins, the tension fibers structured and spaced between the top and bottom skins to lock the top and bottom skins into a predefined shape when the respective bladder is in a fully inflated state. The slipcover has first and second separate chambers together defining a top side of the slipcover and a bottom side of the slipcover. Each chamber corresponding to a respective one of the first and second inflatable bladders, and each chamber is constructed to house a corresponding one of the first and second inflatable bladders therein in their inflated state. A flexible hinge is provided between the first and second separate chambers of the slipcover. The slipcover is adapted to extend in a first configuration in which the first and second chambers extend side-by-side, in which the flexible hinge is located between the first and second chambers and in which the bottom sides of the first and second chambers extend in a substantially common plane (i.e., resting along the top rim of a spa tub), and a second configuration in which the first chamber is folded back onto the second chamber.

DETAILED DESCRIPTION

For purposes of the further discussion, comparisons will be made to conventional spa covers that include a foam core encased in a plastic slipcover. Thus, for purposes of further discussion, the term "foam-core cover" will refer to all such conventional spa covers that include a foam core encased in a vinyl or other water resistant slipcover.

Figure 1:
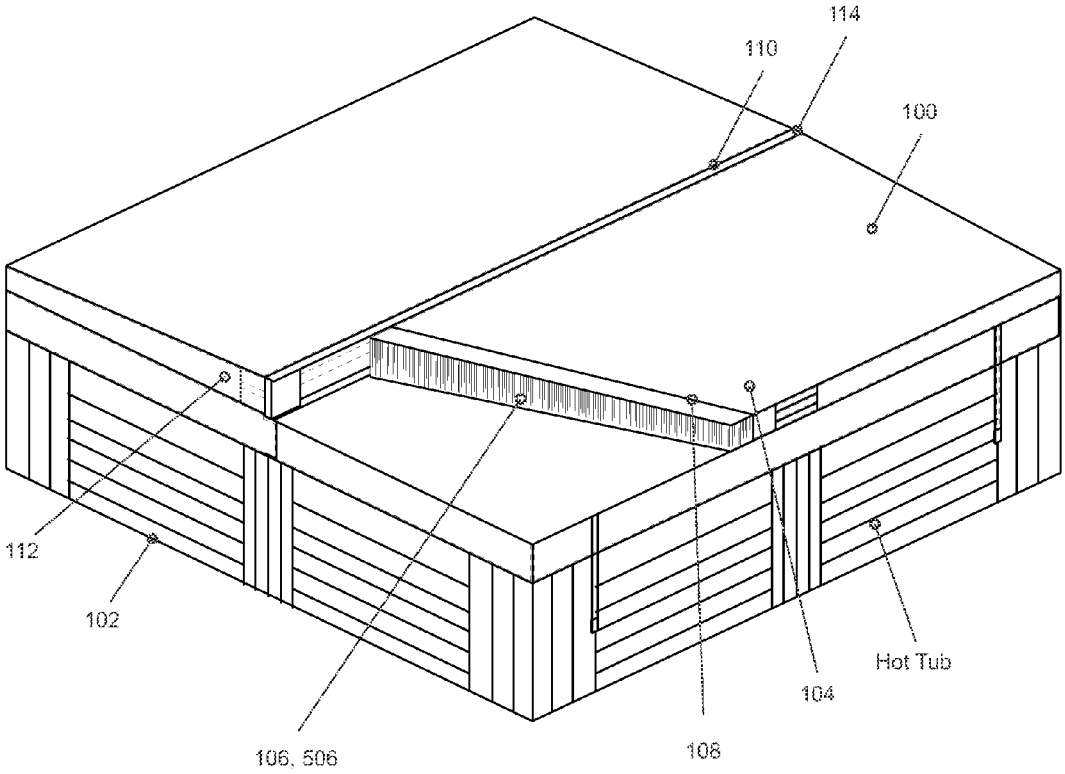
FIG. 1 shows an embodiment of a finished tapered inflatable spa cover on a spa tub.

Turning now to FIG. 1, which shows a partial cutaway of an embodiment of a tapered inflatable spa cover 100 on a spa tub 102, the cover 100 includes a slipcover 104 (i.e., cover skin) and a plurality of inflatable bladders 106 that are received in corresponding separate chambers 108 of the slipcover 104. The chambers 108 are separated by a hinge 110 that may be formed as a portion of the slipcover's skin. The hinge 110 extends across the cover 100 from one edge 112 to an opposite edge 114, generally at the midpoint of the slipcover 104. The hinge 110 permits the chambers 108 of the cover 100 to be folded over each other at the hinge 110 for opening of the cover 100. The hinge 110 permits the cover to be opened and closed in the same way that a foam-core cover is opened and closed and any lifter devices or methods of use of such lifter devices used in conjunction with such foam-core cover can be adapted for use with the covers described herein. The slipcover is preferably made from polyvinylchloride (referred to as PVC or vinyl) or other water proof or water resistant material. As alternatives to PVC, the slipcover may be made of a fabric, including e.g., Sunbrella® (a registered trademark of Glen Raven, Inc.), or a polyester/acrylic mixture.

In one embodiment, the inflatable spa cover 100 has an outward appearance and dimensions that mimic those of a foam-core cover so that the inflatable spa cover 100 can be substituted (i.e., retrofitted) for a respective foam-core cover.

However, because the inflatable spa cover 100 is much lighter in weight than the foam-core cover it can replace, it will be appreciated that use of a lifter or similar device may be optional after the inflatable spa cover 100 is retrofitted. That said, it is recognized that transport, from point of manufacture to consumer, is greatly facilitated as discussed further below.

Figure 3:
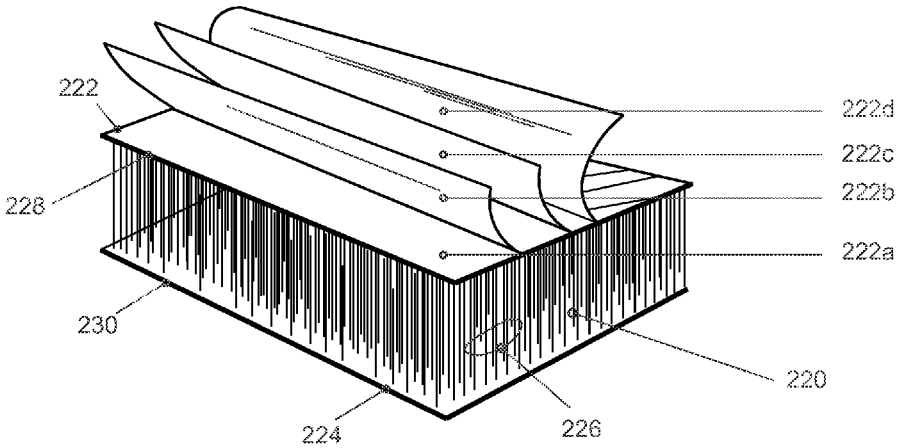
FIG. 3 shows a further detailed view of the internal construction of the portion of the bladder shown in FIG. 2.
Figure 2:
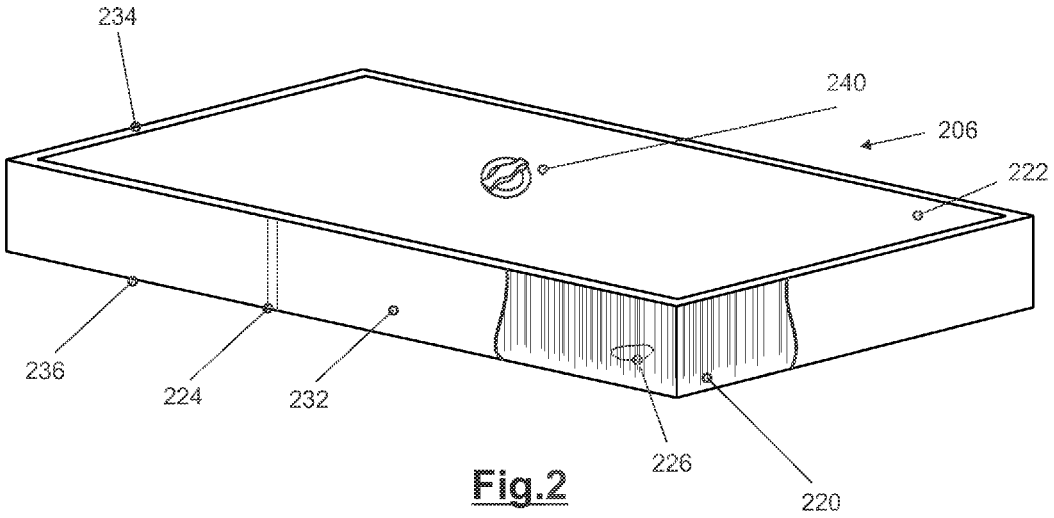
FIG. 2 is an isometric view of a flat inflatable bladder in accordance with an embodiment of the present disclosure showing a portion of the bladder with a bladder banding removed for illustration of an internal construction of the bladder.

In one embodiment, the inflatable bladders are formed of a drop stitch construction. FIGS. 2 and 3 illustrate a drop stitched flat bladder 206. The bladder 206 includes a nylon fiber core 220 sandwiched between a top skin 222 and a bottom skin 224. The core 220 is formed as a plurality of spaced tension fibers (or threads, cables, etc., collectively, "tension fibers") 226 that are joined, e.g., by weaving, to the inner sides of the skins 222, 224 throughout the length and width of the core, described in greater detail below. In one embodiment, the tension fibers are made of nylon. In one embodiment, the tension fibers 226 are spaced about ½ inch apart from each other, although various other spacing is possible. The tension fibers are preferably substantially inelastic. The length, close spacing of the tension fibers 226, and inelasticity of the tension fibers dispose the top and bottom skins 222, 224 in a fixed spaced relation to each other when the bladder 206 is inflated to predefine the shape of the bladders. That is, the tension fibers 226 lock the skins 222, 224 together along with the tension fibers into a single bladder assembly with a defined shape having a thickness substantially corresponding to the length of the tension fibers extending between the top and bottom skins 222, 224.

In one embodiment, the top and bottom skins 222, 224 are formed of a plurality of layers. Also, in one embodiment, the bottom skin 224 may have the same or different layered construction as that of the top skin 222 in both type and numbers of layers. In the embodiment shown in FIGS. 2 and 3, the top skin 222 is formed, from the inside to the outside, of: a nylon base cloth layer 222*a* to which the tension fibers 226 are woven, a first layer of urethane sheeting 222*b*, a second layer of urethane sheeting 222*c*, and a high-density PVC layer 222*d*. Preferably, the fabric of the top and bottom skins has a weight of 2,500 grams/meter$^2$. It will be appreciated that skin arrangements other than that shown in FIG. 3 are possible without deviating from the scope of the present disclosure. By way of example, a single urethane sheeting layer can be used in the top and bottom skins 222, 224. Also, various other optional layers may be included in the skins 222, 224, including, for example, a UV resistant layer.

The top and bottom skins 222, 224 are joined together along their outer edges 228, 230 by a bladder banding 232 that wraps around the core 220. The bladder banding 232 includes a top bladder banding seal 234 and a bottom banding seal 236. The top bladder banding seal 234 seals with the high density PVC layer 222*d* of the top skin 222, and the bottom bladder banding seal 236 seals with a high density PVC layer 224*d* (not shown) of the bottom skin 224. The bladder banding 232 may be sealed to the top and bottom skins 222, 224 by various methods based on the construction of the skins and the banding 232. Some exemplary methods that may be used to seal PVC banding to a PVC layer of the skin include IR welding and adhesives.

The top skin 222 includes a high pressure valve 240 that permits air or other fluid to be introduced into the bladder 206 for inflation or removed from the bladder 206 for deflation. In one embodiment, the valve 240 may be constructed as an inflation valve of a conventional inflatable pool float or air mattress, or the more durable valve suitable for an inflatable boat or raft. One suitable valve is the 69NSBVG boat valve, available from Halkey-Roberts, of St. Petersburg, Fla. While not shown, a plurality of valves may be included in the bladder 206. In one embodiment one high pressure valve (e.g., valve 240) is located in the bottom skin 224, although in other embodiments valves may be located in the top and/or bottom skin, as well as in the banding 232. In one embodiment the bladder 206 may include a first valve for inflation, and a second valve for deflation. Such inflation valve may be a one way valve that permits fluid flow only into the bladder or may be a two way valve that has a suitable orifice to limit or accelerate the rate of outflow of fluid from the bladder. The deflation valve may be constructed to permit rapid deflation of the bladder 206 at a rate that would be higher than through the inlet valve. In one embodiment when the bladder 206 is sealed and the valve(s) is(are) closed, the bladder can sustain pressures up to 15 pounds per square inch (psi), sufficient for the inflatable bladder 206 to withstand the same external loads (e.g., snow load) as a foam cover having the same dimensions as the inflatable cover.

When the bladder 206 is inflated as shown in FIGS. 2 and 3, the top and bottom skins 222, 224 are generally planar and parallel to one another forming a flat slab having a generally rectangular cross section of uniform dimensions throughout the bladder 206. The parallel skin arrangement is due largely to the generally uniform spacing between the skins 222, 224 provided by the nylon fibers 226 of the core 220. The bladder is substantially rigid with relatively hard top and bottom skins when in the inflated state. As will be described herein, other bladder geometries are envisioned, including a tapered bladder (FIGS. 1 and 5) and a crowned bladder (FIG. 6), described in more detail below.

Figure 4:
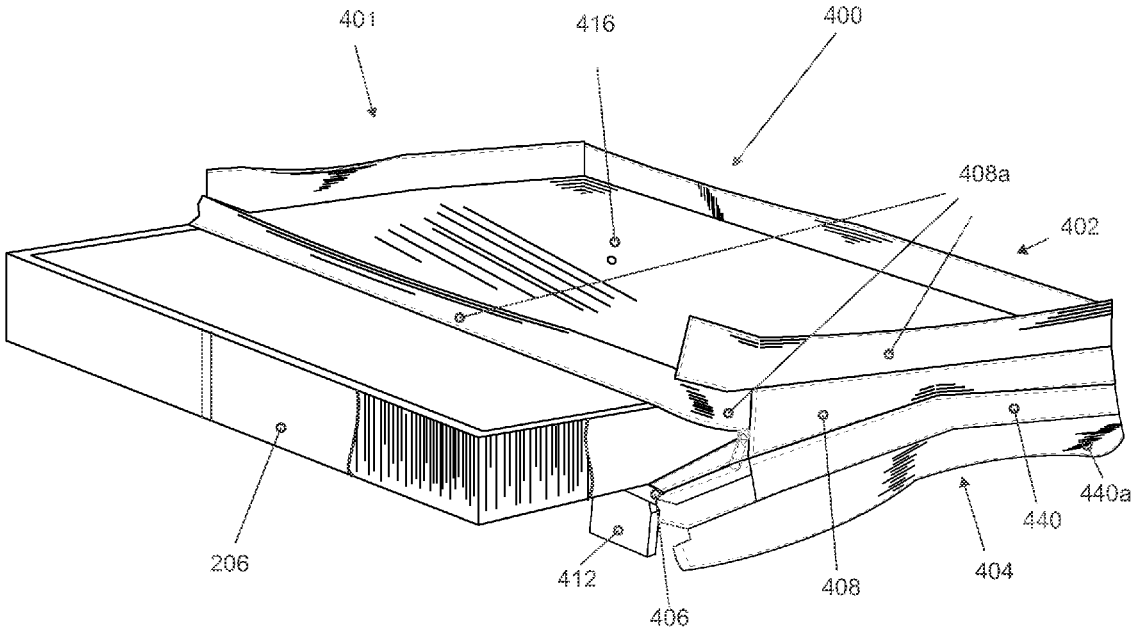
FIG. 4 shows the bladder of FIGS. 2 and 3 partially inserted into a chamber of a slipcover in accordance with an embodiment of the present disclosure.

FIG. 4 shows an embodiment of a partially assembled spa cover 401 that includes two bladders 206 and a slipcover 400. The slipcover 400 has a first portion 402, a second portion 404, and a hinge 406 connecting the first and second portions. The first portion 402 is formed of a skin that defines a first chamber 408, which is zippered. The second portion 404 is formed of a skin that defines a second chamber 410, which is zippered. The slipcover 400 is shown folded over along the hinge 406, thereby partially concealing from view the second zippered chamber 410. An insulating spacer extends 412 extends along the length of the hinge 406 and is directed to face toward the spa tub. The spacer 412 is adapted in thickness to occupy space under the hinge 406 between the chambers 408, 410 when the cover 401 is in a closed (flat) configuration over a spa tub. The two chambers 408, 410 are bordered by respective skirts 408*a*, 410*a*, which, when the cover 401 is closed over a spa tub provides a further seal between the cover 401 and the spa tub to retain heat therein. The first chamber 408 is configured to receive a first bladder 206 and the second chamber 410 is configured to receive a second bladder 206. While the first and second bladders are shown to be the same in FIG. 4, it will be appreciated that the bladders may be different and consequently the chambers for those different bladders may also have different configurations to accommodate such differences in the bladders.

Figure 8:
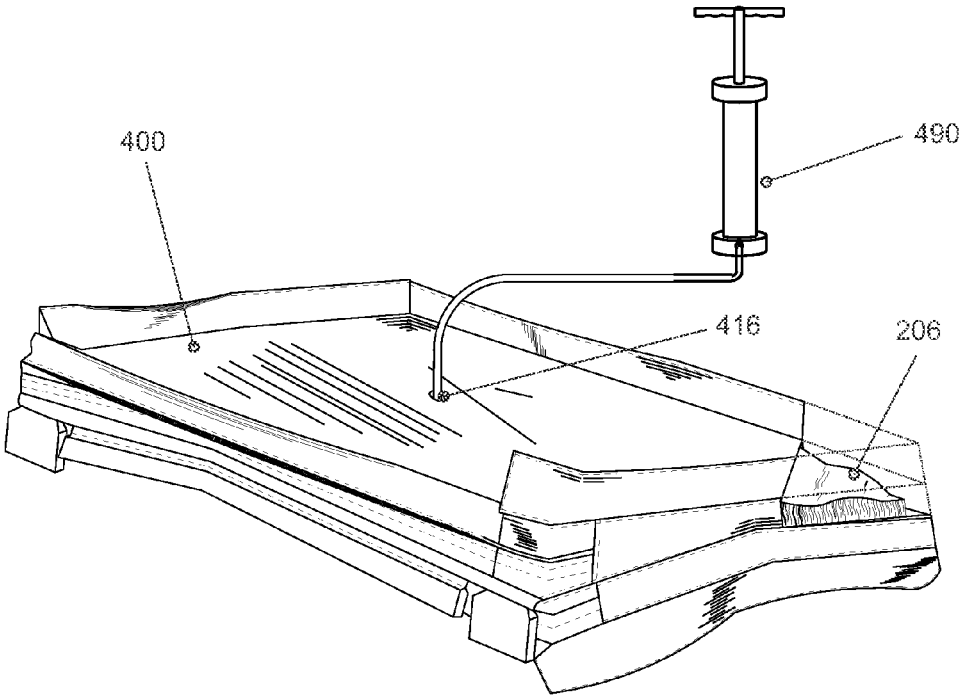
FIG. 8 shows an isometric view of a spa cover in accordance with an embodiment of the present disclosure shown partially inflated while being connected to an air pump.

The first and second bladders 408, 410 and the slipcover 400 are assembled together by opening the respective zippered chambers and introducing the corresponding bladders 206 therein in either an inflated (FIG. 4), deflated, or partially inflated (FIG. 8) condition. When the bladders are fully inserted, the chambers are closed with the zippers.

In one embodiment each portion of the slipcover includes a grommet 416 on the underside (spa tub facing) of each portion 402, 404 near their respective centers. The grommets 416 define openings in the slipcover's skin and those openings communicate with the respective chambers 408, 410 of the first and second portions 402, 404. The openings in the grommets provide drainage for any liquid water that migrates into the chambers 408, 410, such as from water vapor condensing in the chambers and atmospheric precipitation that may have entered the chambers, such as through seams. Such water can drain out of the chambers 408, 410 through the opening in the grommets when the cover is in a closed configuration over the spa tub. Also, in one embodiment shown in FIG. 8, the valve 240 of each bladder 206 is constructed to align with a respective one of the grommets 416 to provide access to the valve 240 through the opening in the grommet when the bladder is disposed in a corresponding chamber. Such access may be useful for opening the valves 240 to inflate or deflate the bladders 206 when assembled with the slipcover 400. Also, such provides ease of coupling pump 490 to the bladders to inflate the bladders when the bladders are inserted into the slipcover prior to inflation, and subsequently inflated.

Figure 5:
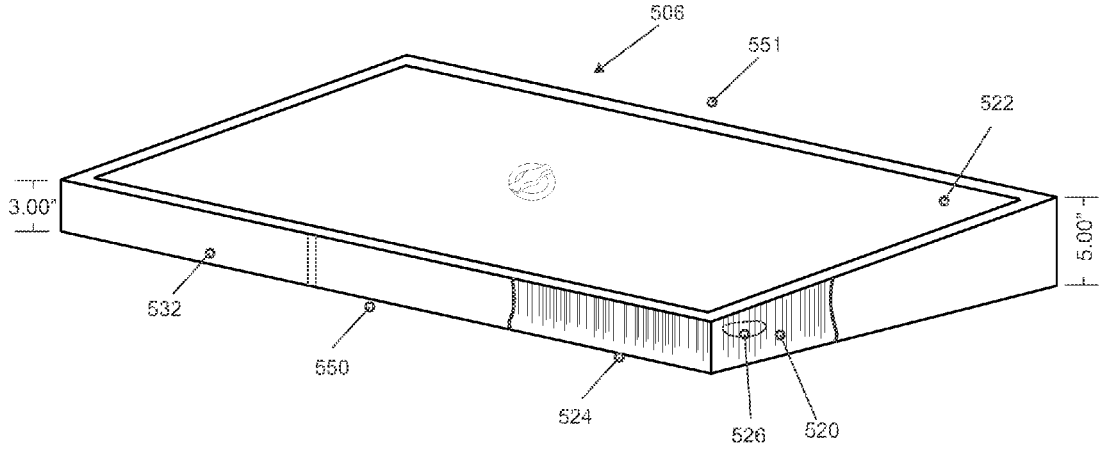
FIG. 5 shows a tapered bladder in accordance with an embodiment of the present disclosure.

FIGS. 1 and 5 show embodiments of tapered inflatable bladders. Similar to the flat bladder 206 shown in FIGS. 2 to 4, the tapered bladder 506 has a drop stitched construction, with a core 520, a top skin 522 joined to the core, a bottom skin 524 joined to the tapered core, and a bladder banding 532 sealed to the top and bottom skins. The top skin 522 and the bottom skin 524 may have the same or different construction as the respective top and bottom skins 222, 224 of the flat bladder 206 shown in FIGS. 2 to 4. Unlike the core 230 of the flat inflatable bladder 206, the core 520 of the tapered bladder 506 has a plurality of nylon tension fibers 526 that have varied length from one end 550 of the core 520 to an opposite end 551, creating a taper between the top and bottom skins 522, 524. In one embodiment, the bladder has a thickness of 5 inches at side 551 and has a thickness of 3 inches at side 550. The tapering of the bladder 506 establishes a pitch that may be useful to shed water and snow from the top of the spa cover when the cover is closed over the spa tub. In one embodiment, like that shown in FIG. 1, for example, two tapered bladders 506 may be introduced into respective tapered chambers 108 so that the thicker (higher) sides 551 face each other opposite the hinge 110 to provide a pitch for water runoff in two opposite directions from the hinge 110.

Figure 6:
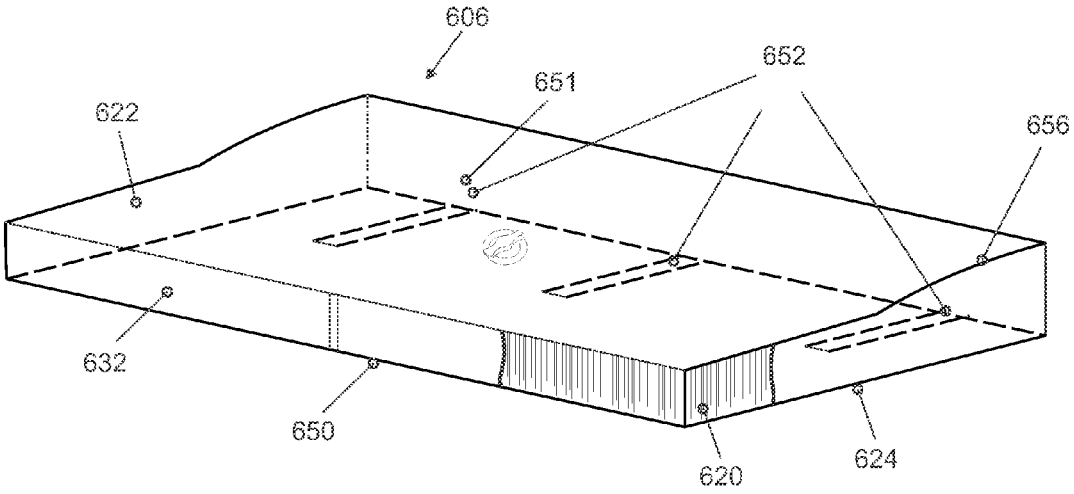
FIG. 6 shows a crowned bladder in accordance with another embodiment of the present disclosure.
Figure 7:
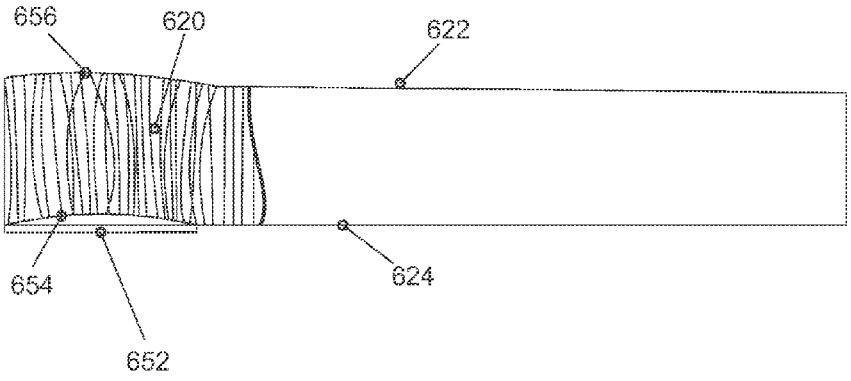
FIG. 7 shows a view of the bladder shown in FIG. 5 along section 7-7 in FIG. 6.

FIGS. 6 and 7 show yet another embodiment of an inflatable bladder 606 having a drop stitched core 620, a top skin 622 joined to the core, a bottom skin 624 joined to the core, and a bladder banding 632 sealed to the top and bottom skins 622, 624. The bladder 606 generally has a multilayered skin construction like that of the flat bladder 206 of FIGS. 2 and 3. In the embodiment of FIGS. 6 and 7, the bladder 606 is provided with a crowned profile 656 along the top skin 622 of the bladder 606, which can be useful for approximating the pitch of a bladder having a tapered drop stitch core (i.e., bladder 506). However, unlike the tapered core 520, which employs tension fibers of varying length to achieve the taper, the core 620 of bladder 606 shown in FIG. 7 has a uniform thickness, like the flat bladder 206 of FIGS. 2 and 3. To achieve the crowned profile, tensioning straps 652 are provided that extend from a first edge 651 of the bladder 606 to a position forward of the first edge (i.e., toward an opposite second edge 650). Tension in the tensioning straps 652 pulls on the bottom skin 624 to create a concavity (i.e., an arch) 654 (FIG. 7) in the bottom skin 624 of the bladder 606, which consequently forms a convexity (i.e., a crown) 656 on the top skin 622 of the bladder 606 between the ends of the tension straps 652. The connection points of the tension straps 652 define the overall length of the convexity 656 on the top skin 622. For example, the longer the tension straps 652, the longer will be the length of the convexity 656, and the shorter the tension straps 652, the shorter will be the length of the convexity 656. Also, the tension in the tensioning straps 652 defines the relative steepness of the convexity 656. For example, greater tension in the tensioning straps will create a sharper concavity 654 resulting in a sharper convexity 656, whereas less tension in the tensioning straps 652 will create a shallower concavity 654 resulting in a shallower convexity 656. One of skill in the art of drop stitched inflatable constructions would likely appreciate that the crowned bladder 606 allows for a variety of profiles to be produced from a single flat inflatable bladder simply by adjusting the length and/or tension in the tensioning straps 652. On the other hand, the tapered bladder requires greater customization and specialized equipment to produce a respective tapered drop stitch core.

Figure 9:
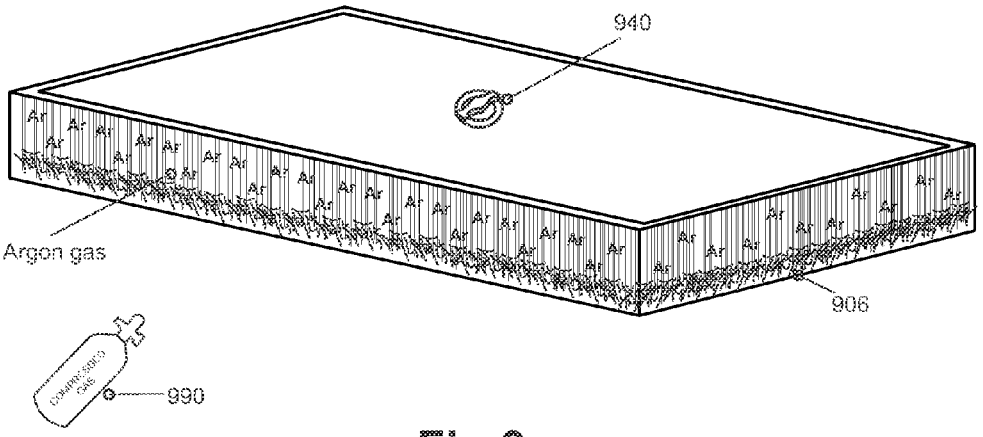
FIG. 9 shows an embodiment of an inflatable bladder filled with 90% argon and 10% air and a canister of a compressed argon/air gas mixture.

As described hereinabove the bladders 106, 206, 506, and 606 are inflatable. The bladders can be inflated with various materials, including solids and gases. For example, FIG. 9 shows an embodiment of an inflatable bladder 906 formed by drop stitching that is inflated with a plurality of gases, notably air and argon, and more particularly a mixture of 10% air and 90% argon. In comparison to one bladder 906 being filled only with air, the use of the air/argon mixture increase the R value of the same bladder 906 by a factor of 3. In one embodiment, the bladder 906 may be manufactured and shipped to a customer in a deflated condition and the customer may be supplied with a supply of the argon/air mixture, such as in a canister 990. The customer may then inflate the bladder 906 with the argon/air mixture by introducing the mixture through the valve prior to or after assembling the bladder 906 with a slipcover (e.g., slipcover 400).

Figure 10:
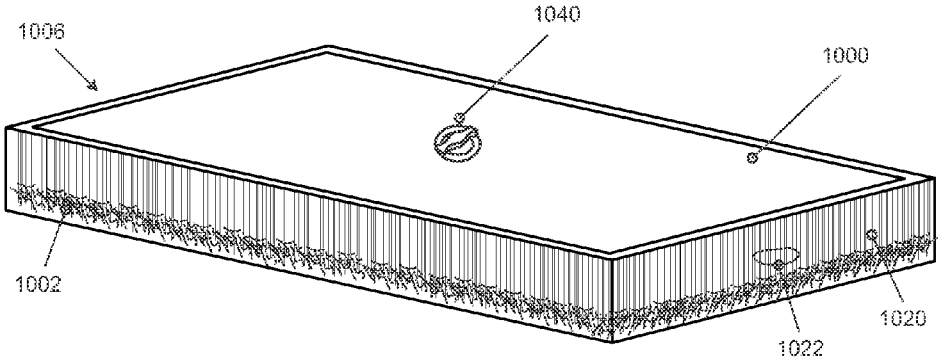
FIG. 10 shows an embodiment of an inflatable bladder filled with air and fiberglass.

FIG. 10 shows an embodiment of a drop stitched inflatable bladder 1006 filled with air and loose insulative fiberglass 1002. The fiberglass 1002 is distributed at the bottom of a drop stitched core 1020 of the bladder 1006 and is preferably evenly distributed between tension fibers 1022 throughout the area of the core 1020. The insulative fibers of the fiberglass preferably have a fiber length that is less than the spacing between the nylon spacing fibers of the drop stitch construction to facilitate placement of the fiberglass fibers between the spaced tension fibers, e.g., by blowing the fiberglass fibers between the tension fibers. For example, the fiberglass fibers have a length less than 0.5 inch in one embodiment. The fiberglass 1002 is preferably introduced into the bladder during manufacturing so that the customer need only be concerned with adding or removing air through a valve 1040 to inflate or deflate the bladder 1006. The fiberglass 1002 may be useful to increase the R value of the bladder 1000 in comparison to the same bladder 1006 that is inflated only with air. In one embodiment, the fiberglass/air mixture in the bladder 1006 increases the R value by a factor of 2.2 over the bladder filled only with air. Other solid fibrous and non-fibrous insulative material may be substitute for or added to the fiberglass fibers, including, but not limited to, natural insulative fibers (e.g., cellulose fibers, cotton fibers), and foam fibers, pellets or shreddings.

Figure 11:
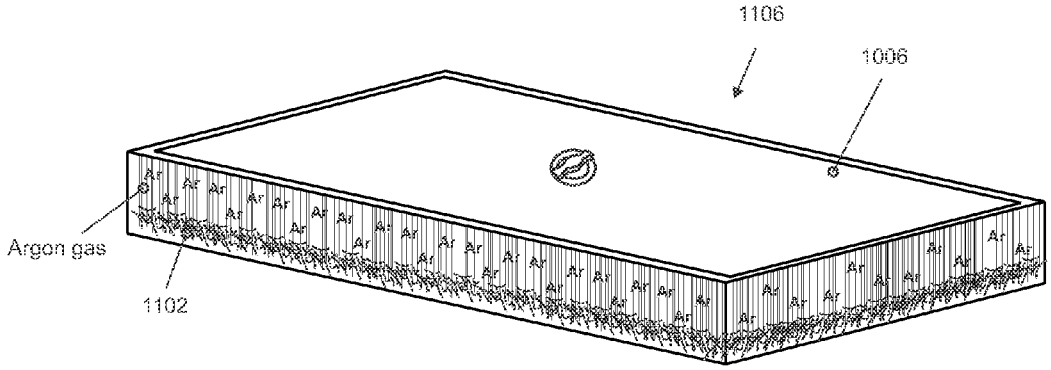
FIG. 11 shows an embodiment of an inflatable bladder filled with a mixture of 90% argon/10% air, and fiberglass.

FIG. 11 shows another embodiment of a bladder 1106 that combines the features of bladders 906 and 1006. Specifically, the bladder 1106 includes the bladder 1006, but with the argon/air mixture of FIG. 9 substituted for the 100% air used in bladder 1006. The use of the argon/air mixture along with the fiberglass 1002 increases the R value of bladder 1106 by a factor of 5.2 over the bladder 1106 filled only with air.

The inflatable cover can be manufactured and transported in a deflated state. Such cover is substantially smaller in volume and lighter in weight than a conventional foam core spa cover. After transport, preferably to the final destination, the spa cover is inflated to full size. The feature significantly facilitates transport and reduces shipping costs.

There have been described and illustrated herein several embodiments of an inflatable bladder and spa cover. While particular embodiments of the invention have been described, it is not intended that the invention be limited thereto, as it is intended that the invention be as broad in scope as the art will allow and that the specification be read likewise. Thus, while particular bladder geometries and constructions have been disclosed, it will be appreciated that other geometries and constructions are possible as well. In addition, while particular types of materials for inflating inflatable bladders have been disclosed, it will be understood that other materials can be used. For example, and not by way of limitation, spray foam insulation may be used to inflate an inflatable bladder. Also, while each bladder has been described with its own valve, it is recognized that bladder may be placed in fluid communication, and a single valve may be used for inflating both bladders. It will therefore be appreciated by those skilled in the art that yet other modifications could be made to the provided invention without deviating from its spirit and scope as claimed.

What is claimed is:

1. A spa cover, comprising:

first and second inflatable bladders, each of the first and second bladders made of a drop stitch construction including a top skin, a bottom skin, and a fiber core comprising a plurality of tension fibers extending between the top and bottom skins, the tension fibers structured and spaced between the top and bottom skins to lock the top and bottom skins into a predefined shape when the respective bladder is in a fully inflated state; and a slipcover having first and second separate chambers together defining a top side of the slipcover and a bottom side of the slipcover, each chamber corresponding to a respective one of the first and second inflatable bladders, wherein each chamber is constructed to house a corresponding one of the first and second inflatable bladders therein in their inflated state, the slipcover having a flexible hinge between the first and second separate chambers, the slipcover adapted to extend in a first configuration in which the first and second chambers extend side-by-side with the flexible hinge located between the first and second chambers and in which the bottom sides of the first and second chambers extend in a substantially common plane, and a second configuration in which the first chamber is folded back onto the second chamber.

2. The spa cover according to claim 1, wherein the inflatable bladders have a skin formed of a plurality of layers.

3. The spa cover according to claim 1, wherein the bladders have a tapered top side.

4. The spa cover according to claim 1, wherein the bladders have a crowned top side.

5. The spa cover according to claim 1, wherein the inflatable bladders include at least one tensioning strap that forms a buckle surface on one side of the bladder and a crowned surface on an opposite side of the bladder.

6. The spa cover according to claim 1, wherein the bladder is inflated with at least one of air and argon.

7. The spa cover according to claim 1, wherein further comprising insulating fibers loosely spaced between the top skin and bottom skin and between the tension fibers.

8. The spa cover according to claim 1, wherein the bladder includes at least one valve.

9. The spa cover according to claim 8, wherein the slipcover includes at least one grommet defining a hole that communicates with a corresponding chamber and wherein the hole is aligned with the valve when the bladder is housed in the chamber.

10. The spa cover according to claim 1, wherein the top skin extends parallel with the bottom skin when the bladder is in the inflated state.

11. The spa cover according to claim 1, wherein the top skin extends at an angle with respect to the bottom skin when the bladder is in the inflated state.

12. The spa cover according to claim 1, wherein at least one of the top and bottom skins are comprised of a plurality of layers.

13. The spa cover according to claim 1, wherein the tension fibers are woven with the top and bottom skins.

14. The spa cover according to claim 1, wherein the tension fibers are spaced about ½ inch apart.

15. The spa cover according to claim 1, wherein the tension fibers are inelastic.

16. The spa cover according to claim 1, further comprising a bladder banding sealed to the top and bottom skin around the core.

17. The spa cover according to claim 1, wherein in the second configuration the top side of the slipcover is folded back onto itself.

18. A spa cover, comprising:

first and second inflatable bladders, each of the first and second bladders made of a drop stitch construction including a top skin, a bottom skin, and a fiber core comprising a plurality of tension fibers extending between the top and bottom skins, the tension fibers structured and spaced between the top and bottom skins to lock the top and bottom skins into a predefined shape when the respective bladder is in a fully inflated state, at least one tensioning strap having a first end attached at one edge of the bottom skin and a second end attached at a position on the bottom skin that is spaced from the edge, the tension strap causing the respective bladder to crown along the top skin between the one edge and the position; and a slipcover having first and second separate chambers, each chamber corresponding to a respective one of the first and second inflatable bladders, wherein each chamber is constructed to house a corresponding one of the first and second inflatable bladders therein in their inflated state, the slipcover having a flexible hinge between the first and second separate chambers allowing the first chamber to fold back onto the second chamber.

19. The spa cover according to claim 18, wherein the bladder has a uniform thickness between the top and bottom skin when the bladder is inflated.

20. A spa cover system, comprising:

a spa cover having, i) first and second inflatable bladders, each of the first and second bladders made of a drop stitch construction including a top skin, a bottom skin, and a fiber core comprising a plurality of tension fibers extending between the top and bottom skins, the tension fibers structured and spaced between the top and bottom skins to lock the top and bottom skins into a predefined shape when the respective bladder is in a fully inflated state; and ii) a slipcover comprising first and second separate chambers, each chamber corresponding to a respective one of the first and second inflatable bladders, wherein each chamber is constructed to house a corresponding one of the first and second inflatable bladders therein in their inflated state, the slipcover having a flexible hinge between the first and second separate chambers allowing the first chamber to fold back onto the second chamber;

at least one valve provided in at least one of the first and second bladders for inflating the respective bladders; and at least one container of compressed gas for inflating the first and second inflatable bladders through the at least one valve into the fully inflated state.

21. The spa cover system of claim 20, wherein the container contains compressed argon gas.

* * * * *